US010717578B2

(12) United States Patent
Slack et al.

(10) Patent No.: US 10,717,578 B2
(45) Date of Patent: Jul. 21, 2020

(54) CONTAINER COMPRISING A PAPERBOARD OUTER SHELL

(71) Applicant: Frugalpac Limited, Brightwell, Ipswich (GB)

(72) Inventors: Henry William Slack, London (GB); Martin Myerscough, Woodbridge (GB)

(73) Assignee: FRUGALPAC LIMITED, Brightwell, Ipswich (GB)

( * ) Notice: Subject to any disclaimer, the term of this patent is extended or adjusted under 35 U.S.C. 154(b) by 269 days.

(21) Appl. No.: 15/301,082

(22) PCT Filed: Mar. 31, 2015

(86) PCT No.: PCT/GB2015/051000
§ 371 (c)(1),
(2) Date: Sep. 30, 2016

(87) PCT Pub. No.: WO2015/150794
PCT Pub. Date: Oct. 8, 2015

(65) Prior Publication Data

US 2017/0015480 A1 Jan. 19, 2017

(30) Foreign Application Priority Data

Apr. 4, 2014 (GB) ..... 1406075.0

(51) Int. Cl.
*B65D 77/06* (2006.01)
*B65D 23/02* (2006.01)

(52) U.S. Cl.
CPC ..... *B65D 77/062* (2013.01); *B65D 23/02* (2013.01); *B65D 77/06* (2013.01)

(58) Field of Classification Search
CPC .... B65D 77/062; B65D 77/065; B65D 77/06; B65D 13/04; B65D 5/02; B65D 5/0209; B65D 5/40; B65D 15/05
(Continued)

(56) References Cited

U.S. PATENT DOCUMENTS 1,071,859 A 9/1913 Ballance
1,328,317 A * 1/1920 Claussen ..... B65D 13/04 229/406
(Continued)

FOREIGN PATENT DOCUMENTS

EP 2428355 A1 3/2012
WO 89003353 A1 4/1989
(Continued)

OTHER PUBLICATIONS

PCT/GB2015/051000, International Search Report dated Jul. 23, 2015.
(Continued)

*Primary Examiner* — Fenn C Mathew
*Assistant Examiner* — Jennifer Castriotta
(74) *Attorney, Agent, or Firm* — Hayes Soloway PC

(57) ABSTRACT

A container has a paperboard outer shell and an inner lining. The container also has a main body portion, a neck portion providing an opening of the container and a base on which the container may be supported in use. The outer shell has a first side wall element including a part of the neck portion and a part of the main body portion of the container; a second side wall element including a part of the neck portion and a part of the main body portion of the container; and a third base element including the base of the container. The first, second and third elements are separate elements bonded together to form the shell, and are formed from flat sheet material pressed to form the 3-dimensional shape of the shell.

25 Claims, 8 Drawing Sheets

(58) Field of Classification Search
USPC ..... 215/11.3, 400; 220/23.91
See application file for complete search history.

(56) References Cited

U.S. PATENT DOCUMENTS

| | | | | |
|---|---|---|---|---|
| 2,338,604 | A * | 1/1944 | Silveyra | B65D 25/16 229/117.3 |
| 3,484,011 | A | 12/1969 | Greenhalgh et al. | |
| 4,256,231 | A | 3/1981 | Cioc et al. | |
| 5,156,295 | A | 10/1992 | Gordon et al. | |
| 5,429,263 | A * | 7/1995 | Haubenwallner | B65D 77/06 215/11.3 |
| 2011/0036846 | A1* | 2/2011 | Corbett | B65D 77/06 220/495.03 |
| 2011/0290798 | A1* | 12/2011 | Corbett | B65D 11/04 220/62.12 |
| 2012/0097632 | A1* | 4/2012 | West | B65D 1/023 215/40 |
| 2012/0145710 | A1 | 6/2012 | Corbett et al. | |
| 2012/0168461 | A1* | 7/2012 | Topits | B65D 47/0804 222/105 |
| 2013/0233912 | A1 | 9/2013 | Piotrowski | |
| 2016/0144993 | A1* | 5/2016 | George | B65D 15/08 229/404 |

FOREIGN PATENT DOCUMENTS

| | | | |
|---|---|---|---|
| WO | 2007060450 | A2 | 5/2007 |
| WO | 2010054334 | A2 | 5/2010 |
| WO | 2010071815 | A1 | 6/2010 |

OTHER PUBLICATIONS

GB1406075.0 Examination Report dated Jun. 14, 2016.
GB1406075.0 Search Report dated Aug. 18, 2014.
GB1613328.2 Search Report dated Sep. 7, 2016.
GB1613329.0 Search Report dated Sep. 5, 2016.

* cited by examiner

CONTAINER COMPRISING A PAPERBOARD OUTER SHELL

BACKGROUND a. Field of the Invention

This invention relates to containers. In particular this invention relates to bottles having an outer cardboard shell and an inner lining or pouch and to a method of manufacture of such bottles.

b. Related Art

There is a general desire and need to reduce the amount of waste that is produced and a drive to recycle as much as possible. One particular area that is receiving a lot of attention is containers for food and drink.

Traditionally wine has been stored and sold in glass bottles. The glass used is relatively heavy and typically makes up about 40% of the weight of the filled bottle of wine. This means that the transportation costs are high.

Furthermore, glass breaks relatively easily when, for example, a bottle is dropped. The bottle will typically break into sharp fragments which may cause injury to a consumer.

It is known to make a bottle having a pulp moulded cardboard outer shell and a blow moulded inner plastics lining. Although these containers have a decreased weight compared to glass bottles, they have a number of disadvantages. The shelf life of the wine within the bottles is decreased compared to glass bottles, it is difficult to apply print to the outer surface of the bottle and the unit cost of manufacture is typically significantly greater than the unit cost of a glass bottle.

It is, therefore, an object of the present invention to provide an improved bottle that overcomes at least some of the disadvantages of previous bottle designs.

SUMMARY OF THE INVENTION

According to a first aspect of the present invention there is provided a container comprising a paperboard outer shell and an inner lining, the container having a main body portion, a neck portion providing an opening of the container extending from a first end of the main body portion and a base on which the container may be supported in use being provided at a second end of the main body portion, and the outer shell comprising:

- a first side wall element including a part of the neck portion and a part of the main body portion of the container;
- a second side wall element including a part of the neck portion and a part of the main body portion of the container; and
- a third base element including the base of the container, wherein, said first, second and third elements are separate elements bonded together to form the shell, and wherein said first, second and third elements are formed from flat sheet material pressed to form the 3-dimensional shape of the shell.

Preferably the flat sheet material is multi-ply paperboard having at least two layers. In this way, an outer layer of the paperboard may provide a good surface for printing.

The first and second elements will typically form a continuous side wall of the shell.

Preferably the first, second and third elements are bonded together with an adhesive. In preferred embodiments the adhesive is a heat activated adhesive.

Preferably the neck portion of each of the first and second elements comprises at least two overlapping layers of sheet material. In preferred embodiments overlapping regions of material are bonded together by an adhesive.

The main body portion may be substantially cylindrical.

Preferably the third element comprises a base panel and a side wall extending substantially perpendicularly from around a perimeter of the base panel. To aid in handling of the container, the base panel preferably comprises a concave recess in an external surface of the base panel.

In preferred embodiments the first and second elements are bonded together to form a generally cylindrical side wall of the container, the base panel is substantially circular, and an outer surface of the side wall of the third element is bonded to an inner surface of the first and second elements.

In other embodiments the third base element comprises a disc. The disc preferably includes a central region and a peripheral skirt region, and the first and second side wall elements are bonded to the skirt region. In preferred embodiments the first and second side wall elements include a plurality of base tabs, and the base tabs are bonded to the skirt region.

Preferably the inner lining comprises a fitment and a bag secured to the fitment, and the fitment is engaged with the neck portion of the shell and the bag extends into the main body portion of the shell.

In particularly preferred embodiments the neck portion of each of the first and second elements includes an aperture. In these embodiments the fitment preferably includes lugs and the lugs preferably protrude through the apertures in the neck portion of the shell. To improve the appearance of the container, the container preferably comprises a flexible strip of material wrapped around the neck portion of the container to cover the lugs and apertures.

The container may comprise embossed or debossed shapes formed in a part of the shell.

According to a second aspect of the present invention there is provided a blank for use in manufacturing a container according to the first aspect of the invention, the blank being formed of a flat sheet of paperboard, and the blank comprising:

- a substantially rectangular main body panel having two opposing side edges and two opposing end edges;
- a central neck panel extending centrally from a first end edge of the main body panel, the central neck panel having first and second side edges and a distal end edge;
- a first outer neck panel extending from the first end edge of the main body panel adjacent to and on a first side of the central neck panel, the first outer neck panel having opposing first and second side edges and a distal end edge, the first side edge being closer to the central neck panel that the second side edge; and
- a second outer neck panel extending from the first end edge of the main body panel adjacent to and on a second, opposite side of the central neck panel to the first outer neck panel, the second outer neck panel having opposing first and second side edges and a distal end edge, the first side edge being closer to the central neck panel that the second side edge.

Preferably a first cut line defines a part of the first side edge of the central neck panel and a part of the first side edge of the first outer neck panel, and a second cut line defines a part of the second side edge of the central neck panel and a part of the first side edge of the second outer neck panel.

Preferably a first tab panel extends from and along at least one of the side edges of the main body panel and a second tab panel extends from the second side edge of at least one of the outer neck panels.

The distal end edges of each of the central and outer neck portions may be aligned. In some embodiments a distal end portion of the first side edge of the first outer neck panel extends in a direction away from the first side edge of the central neck panel, such that a first notch is formed in the blank between distal end portions of the first outer neck panel and the central neck panel, and a distal end portion of the first side edge of the second outer neck panel extends in a direction away from the second side edge of the central neck panel, such that a second notch is formed in the blank between distal end portions of the second outer neck panel and the central neck panel.

Preferably an aperture is provided in the central neck panel. In some of these embodiments the aperture is elongate and extends in a direction parallel to a longitudinal axis of the blank that extends between the first and second end edges of the main body panel.

In some embodiments a plurality of tabs extends from the second end edge of the main body panel.

According to a third aspect of the present invention there is provided a method of manufacturing a container according to the first aspect of the invention, the method comprising the steps of:

- cutting a first side wall blank from a flat sheet of paperboard material;
- hot pressing the first side wall blank to form the first side wall element;
- cutting a second side wall blank from a flat sheet of paperboard material;
- hot pressing the second side wall blank to form the second side wall element;
- cutting a base blank from a flat sheet of paperboard material;
- hot pressing the base blank to form the third element;
- inserting an inner lining between the first and second side wall elements; and
- bonding the first, second and third elements together to form a shell around said lining.

In preferred embodiments the step of bonding the first, second and third elements together comprises adhering said elements, and preferably the method comprises applying an adhesive to regions of at least one of said first and second side wall blanks.

In embodiments in which each of the first and second side wall blanks is according to the second aspect of the invention, the method preferably comprises forming a neck region of each of the first and second elements by overlapping an edge region of each of said outer neck panels with the central neck panel. Preferably the method comprises, firstly, pressing the central neck panel to form a part of the neck region and, subsequently, pressing the outer neck panels to overlap the central neck panel and form the remainder of the neck region. Preferably the method further comprises adhering the outer neck panels to the central neck panel.

In preferred embodiments the first and second side wall blanks each include an aperture, and the inner lining comprises a fitment having lugs and a bag secured to the fitment. In these embodiments the step of inserting the inner lining between the first and second side wall elements preferably comprises engaging the lugs of the fitment through the apertures of the first and second side wall elements.

In preferred embodiments the first side wall blank is according to the second aspect of the invention and further includes a first tab panel extending from and along at least one of the side edges of the main body panel and a second tab panel extending from the second side edge of at least one of the outer neck panels. In these embodiments the method preferably comprises applying an adhesive to said first and second tab panels, joining the first and second side wall elements such that the tab panels of the first side wall element overlap regions of the second side wall element, and adhering the tab portions of the first side wall element to the second side wall element.

In preferred embodiments the method comprises the steps of:

- positioning a support tube around a part of said inner lining;
- locating said first and second side wall elements around the support tube;
- bonding the first and second side wall elements together; and
- after bonding said elements together, withdrawing the support tube from between the inner lining and the first and second side wall elements.

In some preferred embodiments the third element comprises a base panel and a side wall extending substantially perpendicularly from around a perimeter of the base panel, and the method preferably comprises inserting the third element between the first and second elements and adhering the first and second elements to the side wall of the third element, such that the first and second elements fully surround the side wall of the third element.

In other preferred embodiments the third element comprises a disc including a central region and a peripheral skirt region, the first and second side wall elements include a plurality of base tabs, and the method comprises inserting the third element between the first and second elements and adhering the base tabs of the first and second elements to the skirt portion of the third element.

Preferably the method comprises:

- applying a heat activated adhesive to regions of the first side wall blank;
- hot pressing the first side wall blank to form the first side wall element with the adhesive in a non-activated state; and
- subsequently, activating the adhesive using a heat source to bond the first, second and third elements together.

To improve the appearance of the container, the method preferably comprises printing on a surface of the flat sheet of paperboard material before cutting one or more of the first side wall blank, second side wall blank and base blank from said printed sheet of paperboard. The method may comprise embossing or debossing a shape into a part of the first or second side wall element.

Furthermore, the method preferably comprises wrapping a flexible strip of material around the neck portion of the container after the first, second and third elements have been bonded together.

BRIEF DESCRIPTION OF THE DRAWINGS

The invention will now be further described by way of example only and with reference to the accompanying drawings in which.

DETAILED DESCRIPTION

Figure 1:
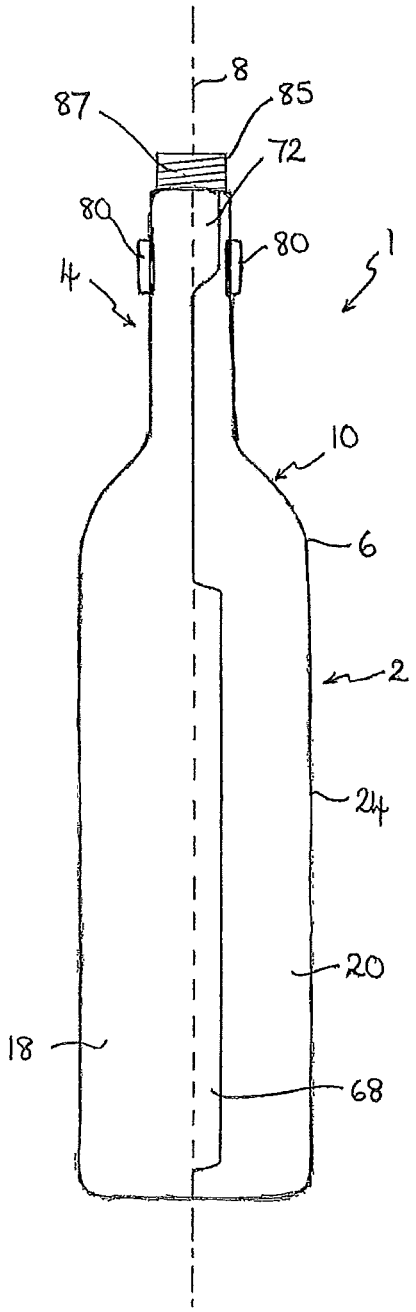
FIG. 1 is a side view of a bottle according to a first preferred embodiment of the present invention.
Figure 2:
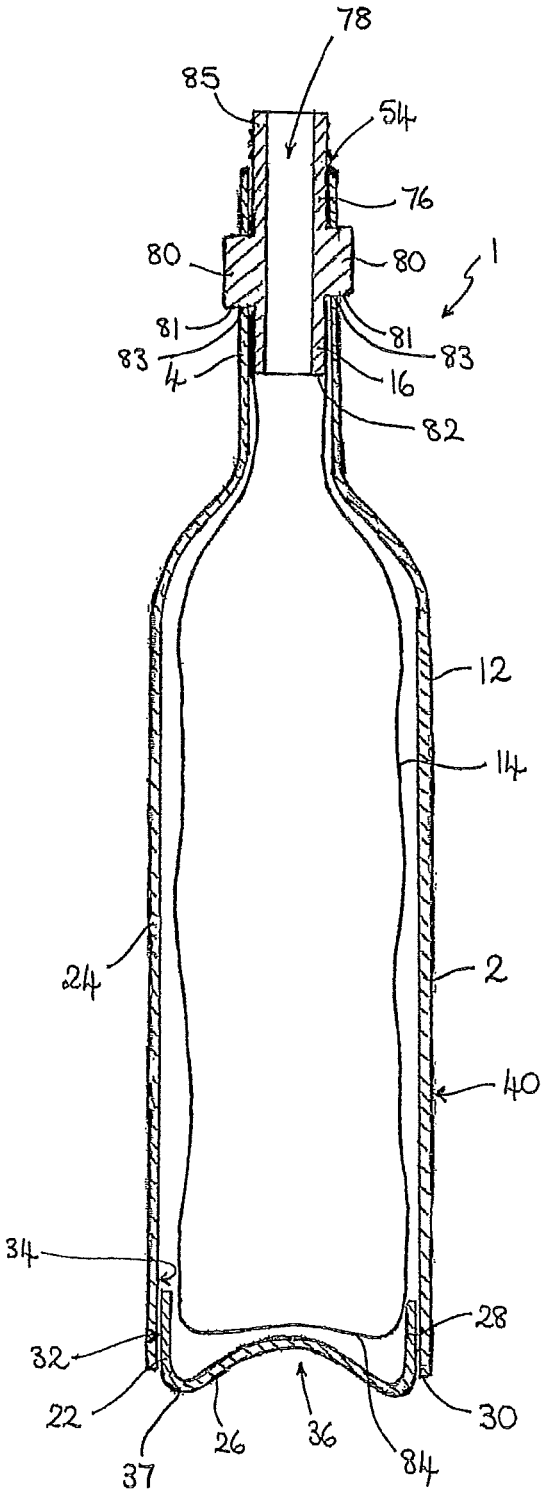
FIG. 2 is a longitudinal cross-sectional view of the bottle of FIG. 1, showing an external shell and an internal bag.
Figure 4:
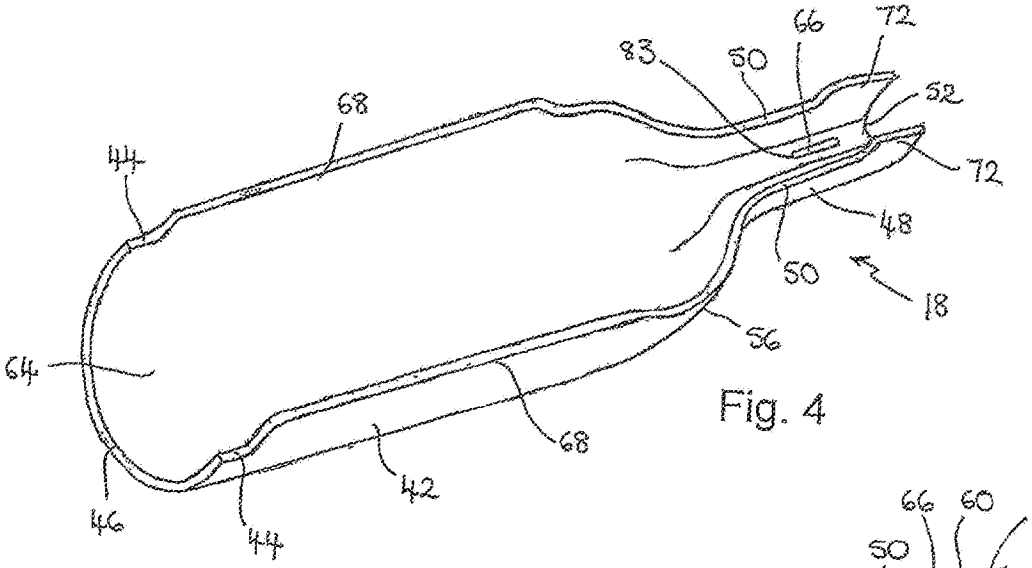
FIG. 4 is a perspective view of one of the side wall elements of FIG. 3.
Figure 5:
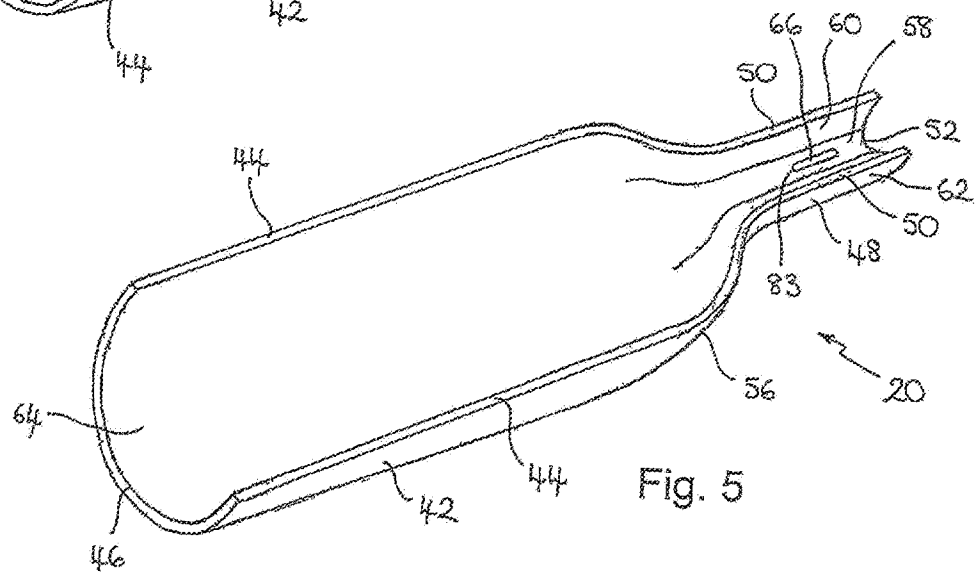
FIG. 5 is a perspective view of the other side wall element of FIG. 3.

FIGS. 1 and 2 illustrate a container 1 in the form of a wine bottle 1 according to a first preferred embodiment of the present invention.

The container or bottle 1 is generally cylindrical and has an elongate, cylindrical main body portion 2 having a first, larger diameter, and an elongate, cylindrical neck portion 4 having a second, smaller diameter. The neck portion 4 extends from a first end 6 of the main body portion 2, and in this example a longitudinal axis 8 of the neck portion 4 is coaxial with a longitudinal axis 8 of the main body portion 2. This axis 8 forms a longitudinal axis of the complete bottle 1. A tapered, shoulder portion 10 of the bottle 1 extends between the neck portion 4 and the main body portion 2.

The bottle 1 comprises an outer shell 12 made of a paperboard or cardboard material and an inner bag 14 supported within the shell 12 by means of a fitment 16. The fitment 16 is engaged with the neck portion 4 of the shell 12 such that the bag 14 is suspended from the fitment 16 and extends downwards into the main body portion 2 of the shell 12, in the orientation shown in FIG. 2. The bag 14 and fitment 16 are, preferably each made of a plastics material.

Figure 3:
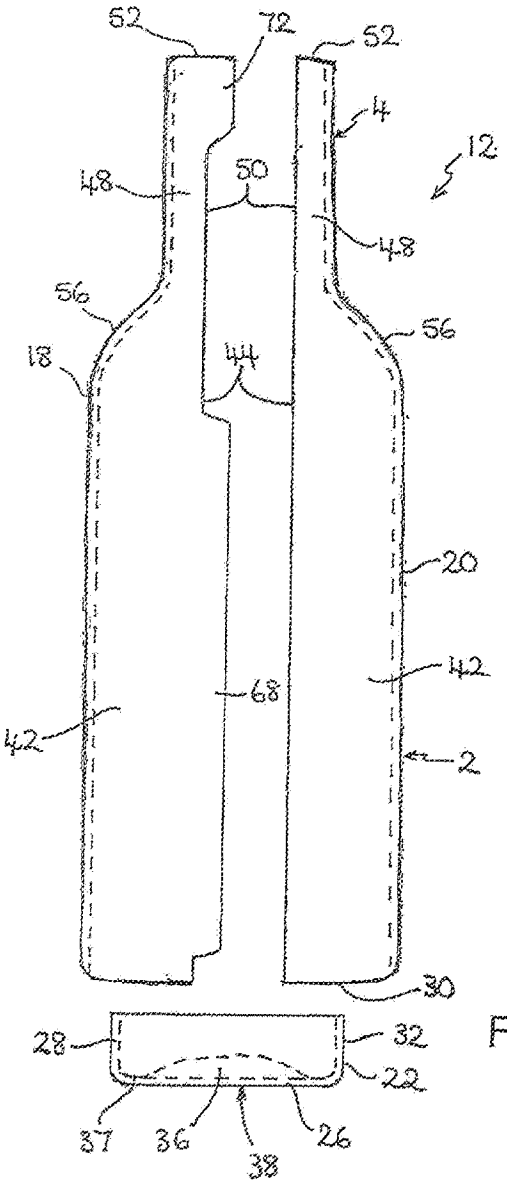
FIG. 3 is an exploded view of the elements of the shell of FIG. 2.
Figure 6:
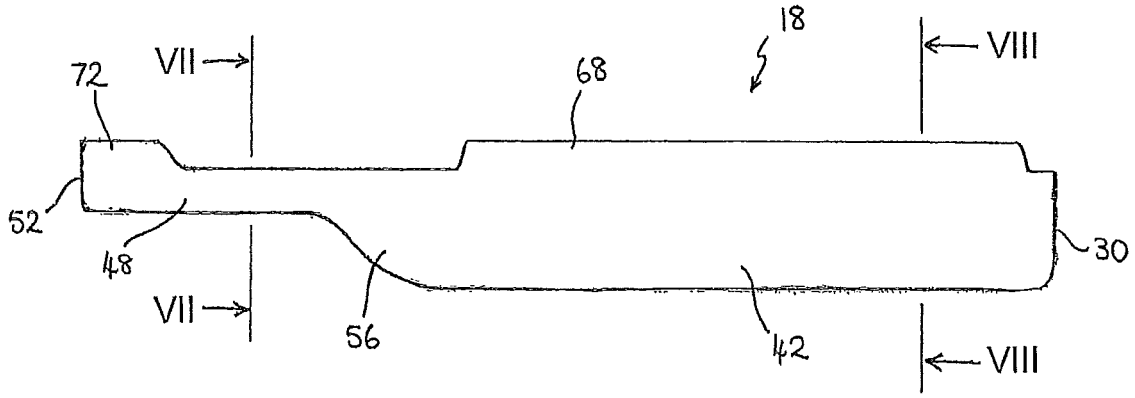
FIG. 6 is a side view of the side wall element of FIG. 4.
Figure 7:
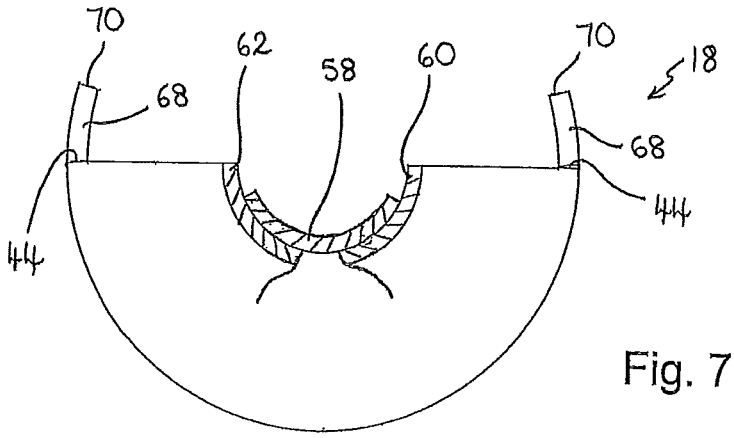
FIG. 7 is a cross-sectional view along the line VII-VII of FIG. 6.
Figure 8:
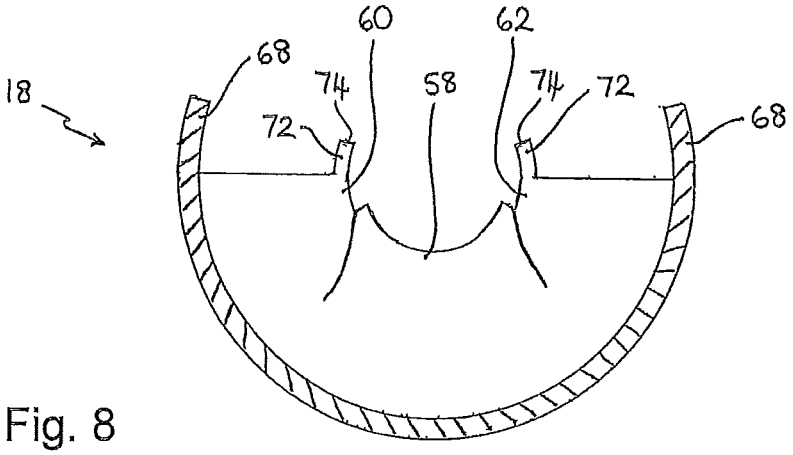
FIG. 8 is a cross-sectional view along the line VIII-VIII of FIG. 6.

The shell 12 is formed of three separate elements that are bonded together, as additionally shown in FIG. 3. The shell 12 comprises a first side wall element 18, a second side wall element 20 and a third base element 22. Each of the first and second side wall elements 18, 20 includes a part of the neck portion 4 of the shell 12 and a part of the main body portion 2 of the shell 12. When the first and second side wall elements 18, 20 are joined together, a part of the first side wall element 18 overlaps a part of the second side wall element 20 to form a complete and continuous side wall 24 of the shell 12.

In this example the base element 22 comprises a base plate 26 and a side wall 28 extending upwards around the perimeter of the base plate 26. The outer diameter of the base side wall 28 is substantially equal to the inner diameter of the side wall 24 of the shell 12. In this way the base element 22 may be inserted into a second end 30 of the main body portion 2 to form a base 32 of the bottle 1, as shown in FIG. 2, and an outer surface 32 of the side wall 28 may be bonded to an inner surface 34 of each of the first and second side wall elements 18, 20.

In preferred embodiments and as illustrated in FIGS. 2 and 3, the base plate 26 may be domed in the centre so as to provide a concave recess 36 in a lower side 38 of the base element 22. This concave or hemispherical recess 36 forms the punt of the bottle 1. Preferably an annular region 37 around the recess, forming the heel of the bottle 1, protrudes from the second end 30 of the main body portion 2 of the side wall 24, and forms a support on which the bottle 1 may stand.

The first, second and third elements 18, 20, 22 of the shell 12 are all made from flat sheets of 100% paperboard that have been pressed to form the required three-dimensional shapes. In preferred embodiments the sheets of paperboard are multi-ply including a first surface layer formed from a paperboard material providing a good surface for printing. This first surface layer may comprise bleached fibres, for example. When the sheets of paperboard are pressed to form the first, second and third elements 18, 20, 22, the orientation of the paperboard is such that this first surface layer forms an external surface 40 of the shell 12.

FIGS. 4 to 8 illustrate the first and second side wall elements 18, 20 of the shell 12 in more detail. In this embodiment a main body portion 42 of each of the first and second elements 18, 20 is semi-cylindrical having a pair of parallel side edges 44; a distance between the side edges 44 defining a diameter of the main body portion 42. An end edge 46, at the second end 30 of the main body portion 42, is semi-annular, and is perpendicular to and extends between the side edges 44.

A neck portion 48 of each of the first and second elements 18, 20 is also semi-cylindrical having a respective pair of parallel side edges 50; a distance between the side edges 50 defining a diameter of the neck portion 48. The side edges 50 of the neck portion 48 lie in the same plane as the side edges 44 of the main body portion 42 and, when the shell 12 is constructed, these side edges 44, 50 also lie in substantially the same plane as the longitudinal axis 8 of the shell 50. An end 52 of the neck portion 48, furthest from the main body portion 42, defines a mouth or opening 54 of the complete shell 12.

A shoulder portion 56 of each of the first and second elements 18, 20 is substantially semi-dome shaped and extends between the main body portion 42 and the neck portion 48.

The neck portion 48 of both of the first and second elements 18, 20 is formed from three panels of cardboard; a central neck panel 58 and two outer neck panels 60, 62. All of the neck panels 58, 60, 62 extend from and are integral with a main body panel 64 that forms the main body portion 42 of the element 18, 20. During manufacture of the shell 12, the neck panels 58, 60, 62 are pressed and shaped such that regions of the outer panels 60, 62 overlap regions of the central panel 58, as shown most clearly in FIG. 7. The transition between the main body panel 64 and the neck panels 58, 60, 62 occurs in the shoulder portion 56 of the element 18, 20 and, accordingly, the regions of overlap do not extend beyond the shoulder portion 56 into the main body portion 42. The overlap between the neck panels 58, 60, 62 creates the decrease in diameter of the neck portion 4 of the shell 12 relative to the main body portion 2.

An elongate aperture 66 is formed in the central neck panel 58 of each of the first and second elements 18, 20. Each aperture 66 extends in a direction substantially parallel to the longitudinal axis 8 of the bottle 1. The apertures 66 are positioned such that when the first and second elements 18, 20 are bonded together to form the shell 12, the apertures 66 are diametrically opposite each other within the neck portion 4. The apertures 66 in the first and second elements 18, 20 are, preferably, identical to each other in size and shape.

In the first element 18, shown most clearly in FIGS. 4, 6, 7 and 8, a first pair of tab portions 68 extends from the side edges 44 of the main body portion 42. The tab portions 68 extend along almost the entire length of the side edges 44. The tab portions 68 and main body portion 42 form a continuous curve, as shown most clearly in FIGS. 7 and 8, such that a distance between distal edges 70 of the tab portions 68 is smaller than the distance between the side edges 44.

Similarly, a second pair of tab portions 72 extends from the side edges 50 of the outer panels 60, 62 of the neck portion 48. In this example these tab portions 72 are positioned proximate the end 52 of the neck portion 48. The tab portions 72 and at least the outer panels 60, 62 of the neck portion 48 form a continuous curve, as shown most clearly in FIG. 8, such that a distance between distal edges 74 of the tab portions 72 is smaller than the distance between the side edges 50.

When the first and second side wall elements 18, 20 are joined together, the tab portions 68, 72 of the first element 18 overlap edge regions of the second element 20, as shown in FIG. 1. In this embodiment the tab portions 68, 72 are located on an external side of the second element 20. Because the tab portions 68, 72 extend inwardly from their respective side edges 44, 50 as described above, during construction of the container 1 the tab portions 68, 72 may be flexed outwardly to enable the respective side edges 44, 50 of the second element 20 to be received between the tab portions 68, 72. The tab portions 68, 72, therefore, have a tendency to grip the second element 20 helping to secure the first and second elements 18, 20 together.

Referring now to FIG. 2, the fitment 16 comprises a trunk portion 76 having a central bore 78 extending therethrough and a pair of lugs 80 extending radially outwardly from the trunk 76. The bore 78 provides a fluid flow path between the internal volume of the bag 14 and the mouth 54 of the shell 12. The lugs 80 are sized and positioned to engage with and protrude through the apertures 66 in the shell 12. In this embodiment the lugs 80 are positioned on opposite sides of the trunk portion 76. In use, therefore, a lower edge 81 of each of the lugs 80 is seated on an end surface 83 of a respective aperture 66 to support the weight of the bag 14 and any liquid held therein.

The bag 14 extends from a first, lower end 82 of the fitment 16. In embodiments in which the container 1 is a bottle for holding wine, the bag 14 is preferably made from a metallised plastics material. Metallisation of the plastics material decreases its permeability and extends the shelf life of the product. The bag 14 is typically gusseted at a lower end 84, furthest from the fitment 16, to enable the bag 14 to form a generally cylindrical shape when the bag 14 is filled with liquid within the shell 12. The metallised bag 14 with its gusseted end 84 tends to adopt a generally elliptical shape when empty. Preferably the bag 14 and fitment 16 are arranged such that the major axis of the ellipse is parallel to a plane containing the lugs 80. The bag 14 will typically be welded to the fitment 16.

A second, upper end 85 of the fitment 16 protrudes from the mouth 54 of the shell 12. A portion of the outer surface of the second end 85 of the fitment 16 exposed above the end 52 of the shell 12 includes screw threads 87. The screw threads 87 are configured to receive and engage with threads of a screw cap (not shown) for sealing the bottle 1.

Figure 9:
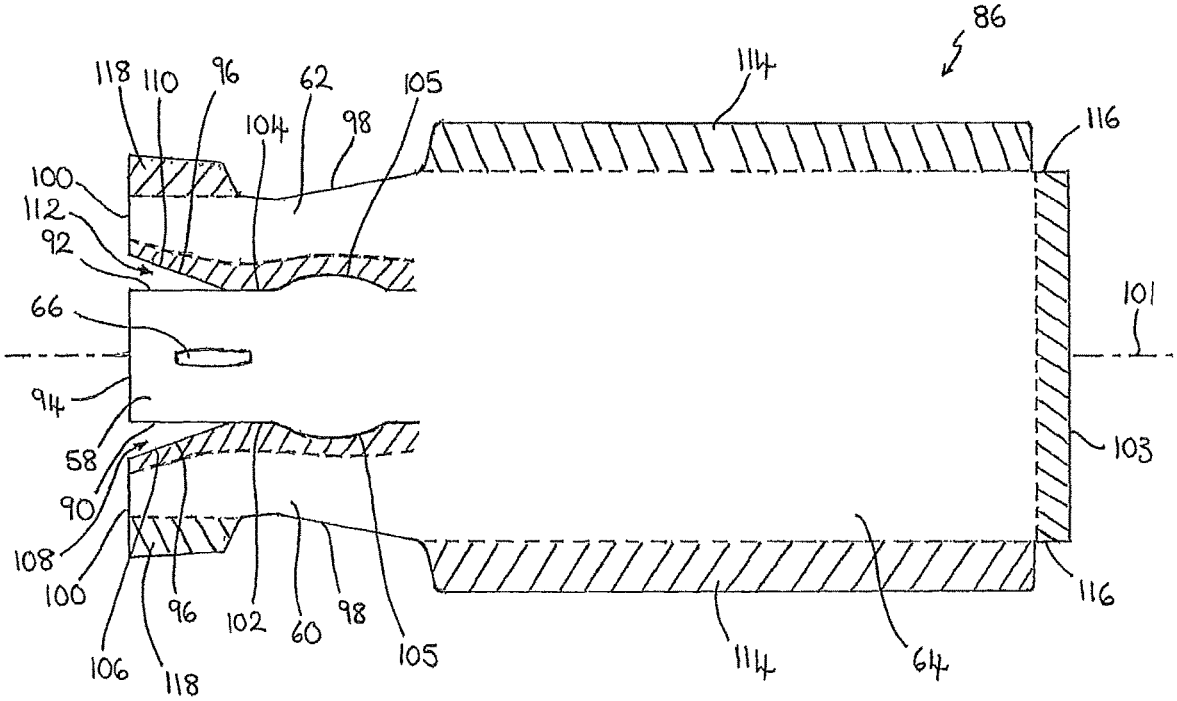
FIG. 9 shows an outline of a blank according to a preferred embodiment of the invention used to form the side wall element of FIG. 4.
Figure 10:
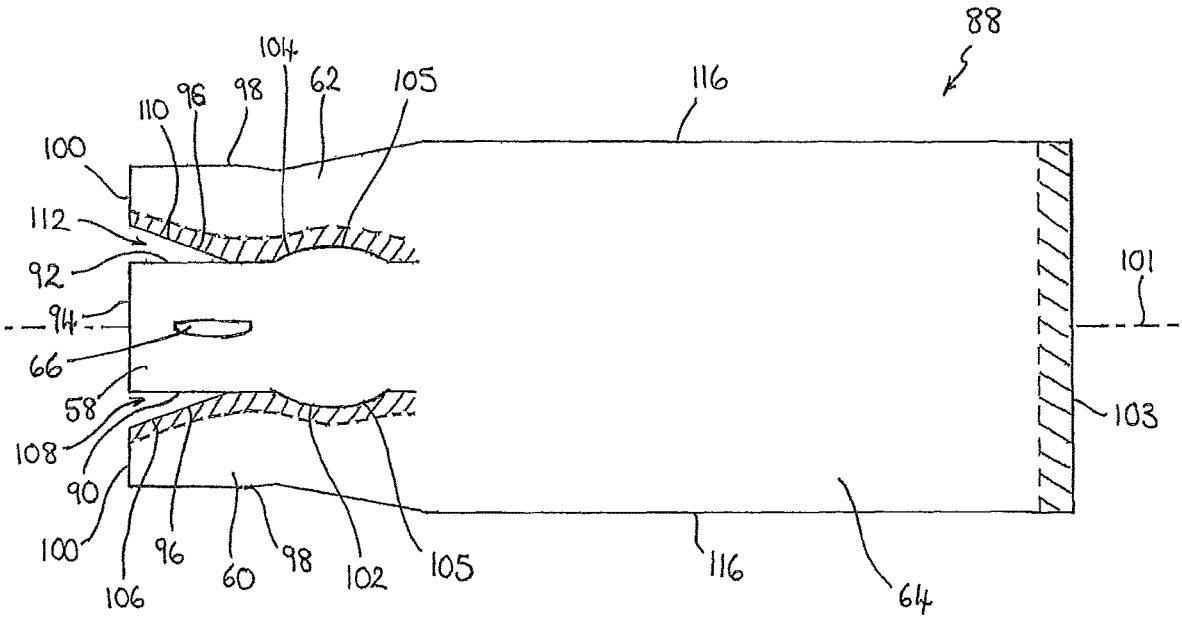
FIG. 10 shows an outline of a blank according to a preferred embodiment of the invention used to form the side wall element of FIG. 5.
Figure 11:
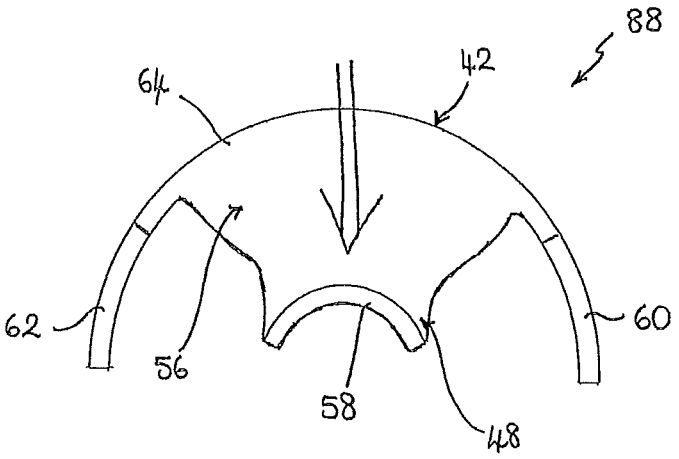
FIG. 11 illustrates a first method step in forming a neck region of the bottle of FIG. 1.
Figure 12:
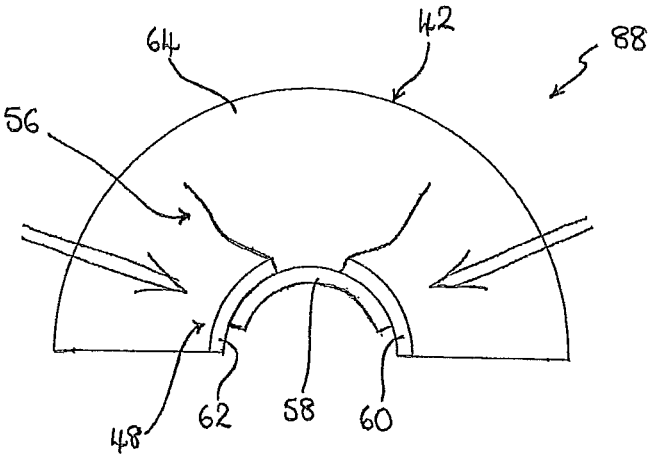
FIG. 12 illustrates a second method step in forming a neck region of the bottle of FIG. 1.
Figure 13:
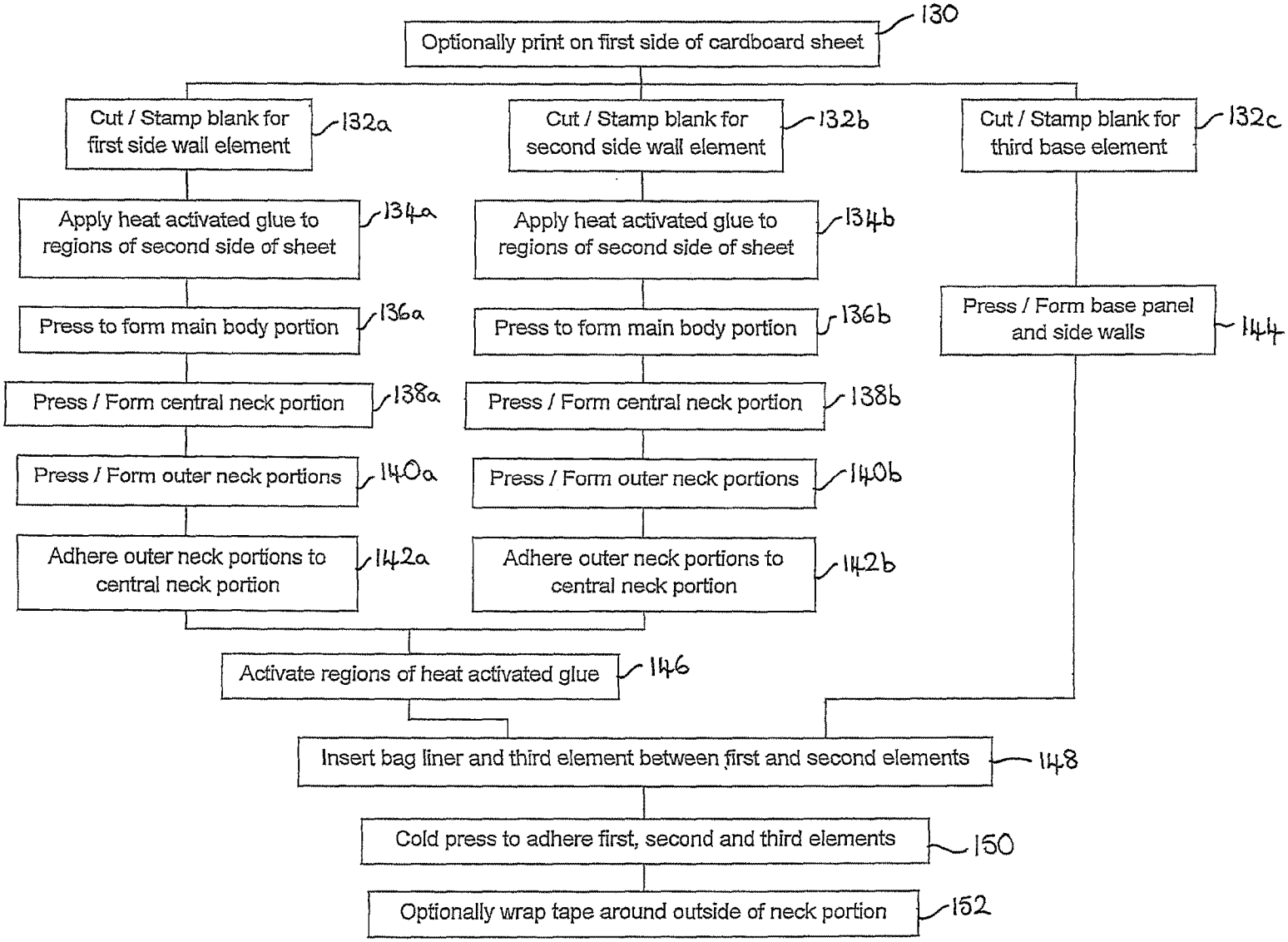
FIG. 13 is a flow chart illustrating the steps in a method of manufacturing the bottle of FIG. 1 according to a preferred embodiment of the present invention.

FIGS. 9 and 10 illustrate a preferred shape of a blank used to form the first and second side wall elements 18, 20 respectively. FIGS. 11 to 13 illustrate a method of construction of the container according to a preferred embodiment.

Referring to FIGS. 9 and 10, a first side wall blank 86 is used to form the first side wall element 18, and a second side wall blank 88 is used to form the second side wall element 20. The first and second blanks 86, 88 are substantially identical to each other, except that the first blank includes regions or panels which form the additional tab portions 68, 72 of the first element 18.

Each of the blanks 86, 88 includes the substantially rectangular main body panel 64 and the three neck panels 58, 60, 62 extending from a first end of the main body panel 64. First and second outer neck panels 60, 62 are positioned on either side of the central neck panel 58. Each of the three neck panels 58, 60, 62 is substantially rectangular. The central neck panel 58 has first and second side edges 90, 92, and a distal end edge 94 furthest from the main body panel 64. The outer neck panels 60, 62 each have first and second side edges 96, 98, and a distal end edge 100 furthest from the main body panel 64. The first side edge 96 of each of the outer neck panels 60, 62 is closer to the central neck panel 58 than the second side edge 98. The distal end edges 94, 100 of each of the neck panels 58, 60, 62 are aligned.

A longitudinal axis 101 of each of the blanks 86, 88 extends between the distal end edge 94 of the central neck panel 54 and an opposing end edge 103 of the main body panel 64. Side edges 116 of the main body panel 64 are parallel to each other and extend parallel to the longitudinal axis 101 of each of the blanks 86, 88.

An aperture 66 is formed in the central neck panel 58 of each of the blanks 86, 88. In this embodiment the aperture 66 is elongate and is centrally located across a width of the central neck panel 58 between the two side edges 90, 92.

In this embodiment a first single cut line 102 in each of the blanks 86, 88 defines a length of both the first side edge 90 of the central neck panel 58 and the first side edge 96 of the first outer neck panel 60 proximate the main body panel 64. A second single cut line 104 in each of the blanks 86, 88 defines a length of both the second side edge 92 of the central neck panel 58 and the first side edge 96 of the second outer neck panel 62 proximate the main body panel 64.

Furthermore, in this embodiment the cut lines 102, 104 define a convex curved lobe 105 extending from each of the side edges 90, 92 of the central neck panel 58 and a corresponding concave curved contour in the first side edge 96 of each of the outer neck panels 60, 62.

A distal end portion 106 of the first side edge 96 of the first outer neck panel 60 extends in a direction away from the first side edge 90 of the central neck panel 58, such that a first notch 108 is formed in each of the blanks 86, 88 between the first outer neck panel 60 and the central neck panel 58 proximate the distal ends 94, 100. Similarly, a distal end portion 110 of the first side edge 96 of the second outer neck panel 62 extends in a direction away from the second side edge 92 of the central neck panel 58, such that a second notch 112 is formed in each of the blanks 86, 88 between the second outer neck panel 62 and the central neck panel 58 proximate the distal ends 94, 100.

The first side wall blank 86 includes a pair of first tab panels 114, each first tab panel 114 extending from and along a side edge 116 of the main body panel 64, and a pair of second tab panels 118, each second tab panel 118 extending from the second side edge 98 of the outer neck panels 60, 62. When the blank 86 is pressed to form the first side wall element 18, the first tab panels 114 become the first tab portions 68 and the second tab panels 118 become the second tab portions 72.

Although the blanks 86, 88 have been described as comprising a plurality of panels 64, 58, 60, 62, 114, 118, it will be appreciated that each of the blanks 86, 88 is unitary and the use of the term panel refers to a region of the blank 86, 88.

A method of construction of the container 1 will now be described with particular reference to the use of the blanks 86, 88 shown in FIGS. 9 and 10. It will be appreciated, however, that other shapes of blanks may be used to construct a container 1 having a main body portion 2 and a neck portion 4 as described herein.

Referring now to FIGS. 11 to 13 in particular, an optional first step 130 in the method of construction of the container 1 comprises printing on a first side of a flat sheet of cardboard or paperboard. As described below, this sheet of paperboard will be used to form the shell 12, and the printed first side will form an external surface of the shell 12. This enables designs and branding to be applied to the container 1 before the shell 12 is formed, thereby decreasing the complexity and costs of applying designs to the container 1.

A second step 132*a*, 132*b*, 132*c* in the method comprises cutting blanks from the sheet of paperboard for forming each of the first, second and third elements 18, 20, 22. Each of these blanks may be cut from the same sheet of paperboard or, alternatively, each type of blank may be cut from a different sheet of paperboard.

For example blanks for forming the first element 18 may be cut from a first sheet, blanks for forming the second element 20 may be cut from a second sheet and blanks for forming the third element 22 may be cut from a third sheet. The blanks will typically be stamped from the sheet(s) of paperboard.

A third step 134*a*, 134*b* in the method comprises applying an adhesive to regions of each of the blanks 86, 88 used to form the first and second side wall elements 18, 20. The adhesive is applied to regions of the second side of the sheet of paperboard, i.e. on an opposite side to the printed side.

The adhesive is applied to regions of the outer neck panels 60, 62 proximate the first side edges 96 and to a region extending along the end edge 103 of the main body panel 64. Additionally, on the first blank 86, adhesive is applied to all of the first and second tab panels 114, 118. These regions of adhesive are indicated by the hatched areas in FIGS. 9 and 10.

The adhesive is, preferably, a heat activated or hot melt adhesive. In some embodiments it may be desirable to apply a first type of adhesive to the outer panels 60, 62 and a second type of adhesive to the end edge 103 and tab panels 114, 118. The different types of adhesive may have different activation temperatures and/or different open times.

The next step 136*a*, 136*b* in the method is to press or form each of the main body panels 64 of the blanks 86, 88 into the required shape to form the main body portion 42 of each of the first and second side wall elements 18, 20 respectively.

The blanks 86, 88 are pressed using suitable heated tools to form, in this embodiment, the semi-cylindrical shape of the main body portions 42. The temperature of the heated tool and the heat insulating properties of the paperboard are such that the adhesive on the blanks 86, 88 is not activated during this pressing step.

Each of the blanks 86, 88 is then pressed or formed to shape the shoulder and neck portions 56, 48 of the first and second elements 18, 20.

In a first step 138*a*, 138*b* in this process the central neck panel 58 is pressed, as illustrated in FIG. 11 for the second blank 88, using suitable heated tools. At least a distal end portion of the central neck panel 58 is formed into a part-cylindrical shape having a longitudinal axis aligned with the longitudinal axis of the main body portion 42. A proximal portion of the central neck panel 58 and a neighbouring part of the main body panel 64 is curved to form a part of the shoulder portion 56 of the first and second elements 18, 20.

In a second step 140*a*, 140*b* the outer neck panels 60, 62 are pressed, as illustrated in FIG. 12 for the second blank 88, using suitable heated tools. At least a distal end portion of each of the outer neck panels 60, 62 is formed into a part-cylindrical shape, and a proximal portion of each of the outer neck panels 60, 62 and a corresponding neighbouring portion of the main body panel 64 is curved to form the remainder of the shoulder portion 56 of each of the first and second elements 18, 20.

The outer neck panels 60, 62 are formed such that regions of the neck panels 60, 62 proximate the fist side edges 96 overlap outer regions of the central neck panel 58 proximate the side edges 90, 92. In this embodiment the distal end portions 106, 110 of each of the first side edges 96 are configured to lie either side of the aperture 66.

Because, in this embodiment, the central neck panel 58 is formed first followed by the outer neck panels 60, 62, the central neck panel 58 lies radially inwards of the outer neck panels 60, 62 in the final container 1, as shown most clearly in FIG. 12. It will be appreciated, however, that in other embodiments the outer neck panels 60, 62 and central neck panel 58 may be formed such that the outer panels 60, 62 lie radially inward of the central neck panel 58.

The next step 142*a*, 142*b* in the method of construction is to adhere the outer neck portions 60, 62, to the central neck portion 58. This may be accomplished in a number of different ways. In a first embodiment the adhesive applied to the outer neck panels 60, 62 is activated by the heat from the tool used to form the outer neck panels 60, 62 as described above. The adhesive is, therefore, activated during or after forming of the outer neck panels 60, 62 at step 140*a*, 140*b*. In a second embodiment, the adhesive on the outer neck panels 60, 62 is activated by a further heat source, for example by hot air, before the outer neck panels 60, 62 are pressed at step 140*a*, 140*b*. In a further embodiment a subsequent heating step is applied, after the outer neck panels 60, 62 have been pressed, to activate the adhesive. This subsequent heating may comprise increasing the temperature of the tools used to form the outer neck panels 60, 62 or may comprise using an additional heat source.

A further step 144 in the construction method is to press or form the base blank into the base element 22 having a base panel 26 and side wall 28. This pressing step 144 may be carried out before, after or during the pressing of the first and second blanks 86, 88. The base blank is pressed or formed using suitable heated tools.

Once all of the first, second and third elements 18, 20, 22 have been formed the complete container 1 can be assembled.

At a first assembly step 146 the areas of adhesive on the tab portions 68, 72 of the first element 18, and the areas of adhesive proximate the end edge 46 of both the first and second elements 18, 20 are activated. The adhesive is preferably activated by a heat source such as hot air. It is clearly desirable and important to activate these areas of adhesive without re-activating the adhesive between the neck panels 58, 60, 62.

At a second assembly step 148 the fitment 16, bag 14 and third element 22 are positioned between the first and second side wall elements 18, 20. In particular, the fitment 16 is positioned so that one of the lugs 80 is engaged with the aperture 66 in the first element 18, and the bag 14 extends into the main body portion 42 of the element 18. The third element 22 is positioned such that a part of its side wall 28 is in contact with the main body portion 42 of the element 18, with the annular region 37 extending from the end 30 of the element 18.

The second side wall element 20 is then positioned such that the other one of the lugs 80 is engaged with the aperture 66 of this element 20, and a part of the side wall 28 of the third element 22 is in contact with the main body portion 42 of the element 20. Additionally the tab potions 68, 70 are positioned to overlap edge regions of the second element 20.

It will be appreciated that in other embodiments the fitment 16 and third element 22 may be engaged initially with the second element 20 and subsequently with the first element 18. In yet further embodiments the fitment 16 and third element 22 may be engaged with the first and second elements 18, 20 simultaneously.

In this embodiment the bag 14 is a metallised bag 14 as described above and, accordingly, has a generally elliptical cross-sectional shape. Importantly, the orientation of the bag 14 relative to the side wall elements 18, 20 is such that the major axis of the ellipse is substantially perpendicular to the plane(s) containing the side edges 44 of the elements 18, 20. As such the bag 14 does not impede contact between opposing side edges 44 of the elements 18, 20 during assembly. Furthermore, the dimensions of the bag 14 are such that as the two elements 18, 20 are brought together, contact between the bag 14 and the main body portions 42 of the elements 18, 20 tends to squash the bag 14 along the major axis. In this way, assembly of the container 1 automatically causes the bag 14 to become more cylindrical within the main body portion 2 of the container 1.

Once the components 18, 20, 22, 16, 14 are correctly positioned such that the fitment 16 is clamped between the neck portions 48, the third element 22 is clamped between the main body portions 42, and the tab portions 68, 70 overlap the second element 20, a third assembly step 150 comprises bonding the first, second and third elements 18, 20, 22 together. This step 150 comprises using unheated or cold tools to press the elements 18, 20, 22 together and cure or set the adhesive, thereby bonding the elements 18, 20, 22 of the shell 12 together.

A final, optional, step 152 in the method of construction of the container 1 is to wrap a strip or band of flexible material around the neck portion 4 of the container 1 to cover the lugs 80 and the apertures 66. The flexible material may be in the form of adhesive tape, metal foil or a shrink wrap material, for example.

Once the container 1 has been constructed the bag 14 can be filled with a liquid, for example wine, through the mouth 54 and bore 78. The container 1 is then sealed closed using a suitable sealing means, such as a screw cap (not shown), engaged with either the fitment 16 or the neck portion 4 of the shell 12.

Figure 14:
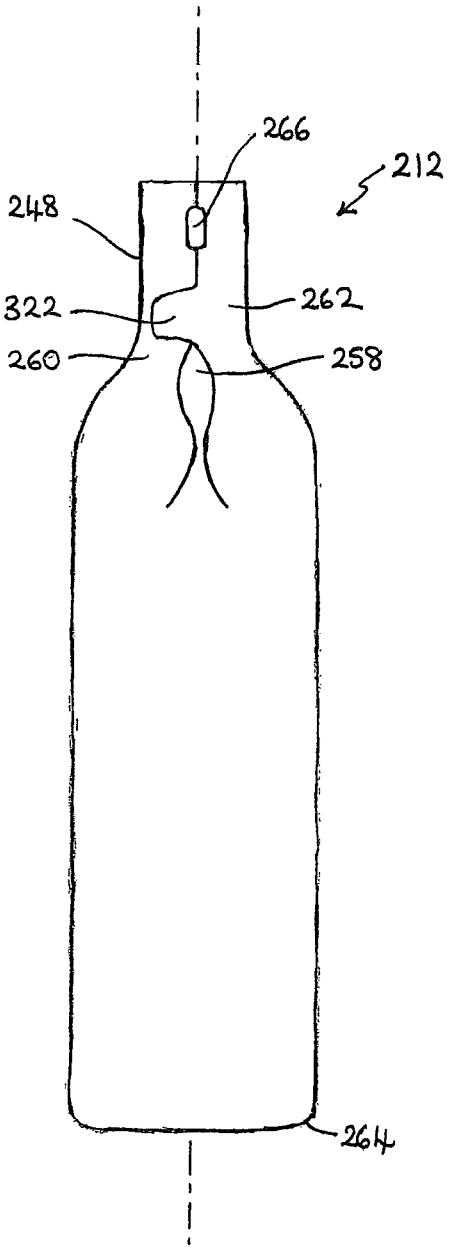
FIG. 14 is a side view of a shell of a bottle according to a second preferred embodiment of the present invention.
Figure 15:
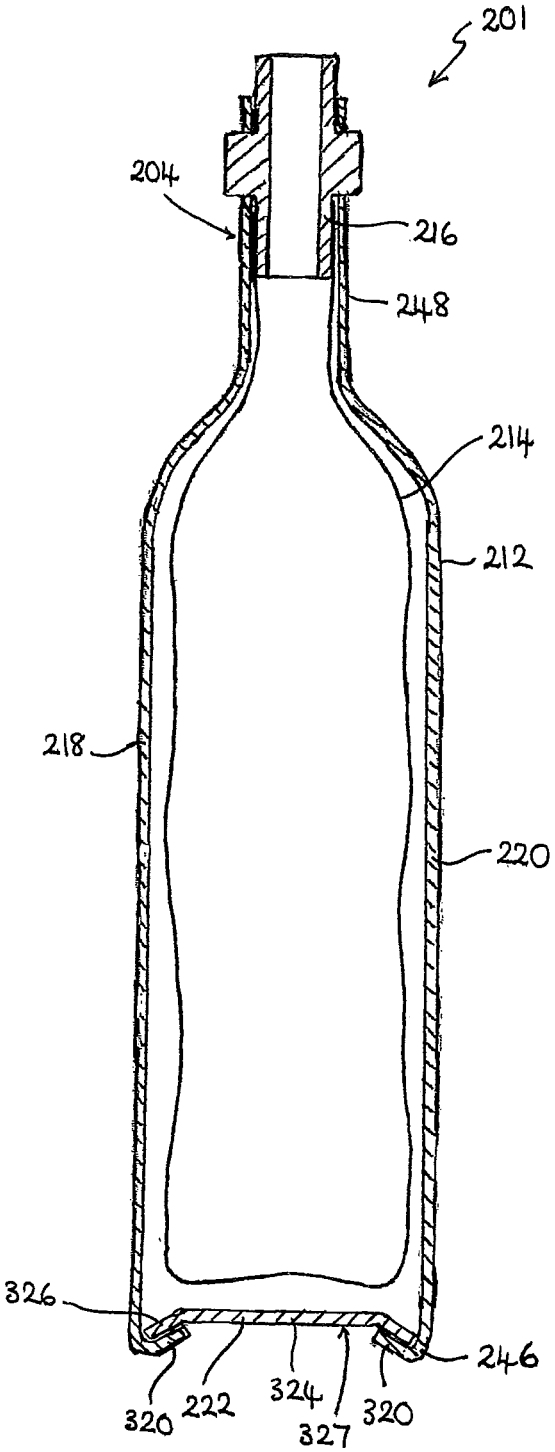
FIG. 15 is a longitudinal cross-sectional view of a bottle including the shell of FIG. 14 and an internal bag.

A second embodiment of a container 201 in the form of a bottle 201 is illustrated in FIGS. 14 and 15. The bottle 201 is substantially the same as the bottle 1 of the first embodiment and like features have been indicated by reference numerals incremented by 200.

The bottle comprises an outer shell 212 made of a paperboard or cardboard material and an inner bag 214 supported within the shell 212 by a fitment 216. The shell 212 is formed of three separate elements that are bonded together by a suitable adhesive. In particular, the shell 212 comprises a first side wall element 218, a second side wall element 220 and a third base element 222. The side wall elements 218, 220 are substantially identical to the side wall elements 18, 20 of the first embodiment except for two features.

Firstly, each of the side wall elements 218, 220 includes a plurality of base tabs 320 extending from a second, lower end edge 246. Once the bottle 201 is fully constructed these base tabs 320 extend radially inwardly and are bonded to the base element 222 as described further below.

Secondly, one of the outer neck panels 262 of the neck portion 248 of one of the side wall elements 220 includes a neck tab 322. When the bottle 201 is constructed, as shown in FIG. 14, the neck tab 322 extends over another of the outer neck panels 260 and is not adhered to the neck panel 260 such that, after use of the bottle 201, a user may grip and pull the tab 322 to break apart the neck portion 248 of the bottle 201 to remove the fitment 216 and bag 214 from the shell 212.

The base element 222 is formed from a circular disc of paperboard or cardboard and includes a planar central region 324 and a peripheral skirt portion 326 that extends fully around the circumference of the central region 324. The skirt portion 326 comprises an edge region of the disc that has been pressed so as to extend at an angle to the planar central region 324. In this way, a first surface 327 of the base element 222 has a substantially concave shape.

Figure 16:
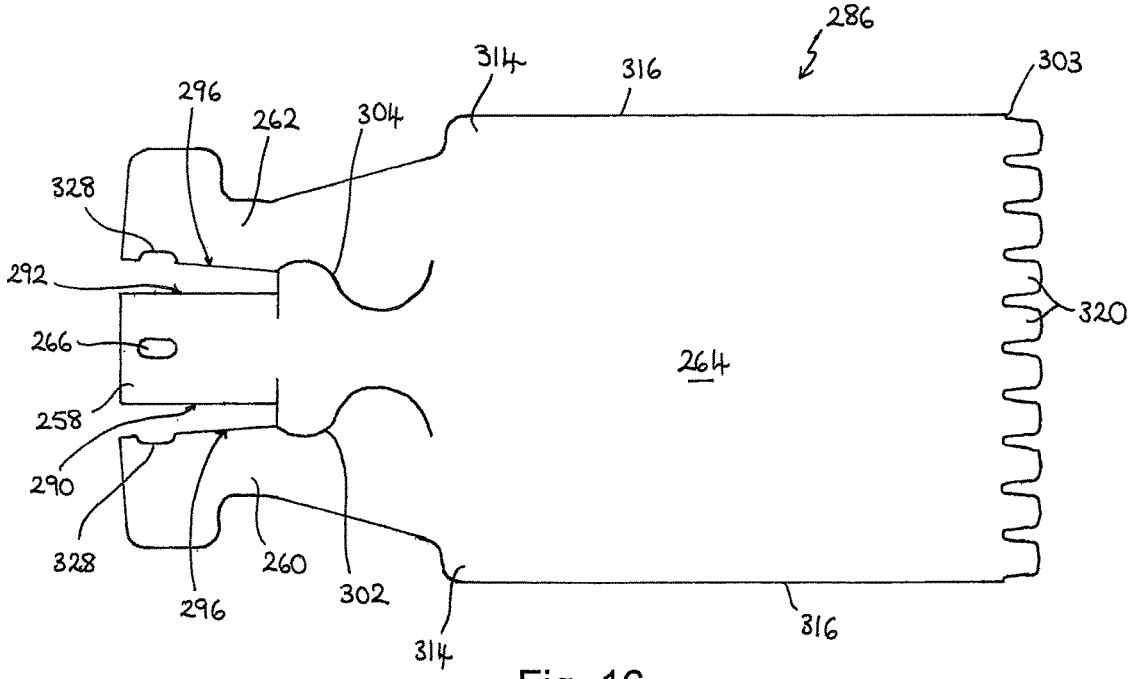
FIG. 16 shows an outline of a blank according to a preferred embodiment of the invention used to form a first side wall element of the shell of FIG. 14.
Figure 17:
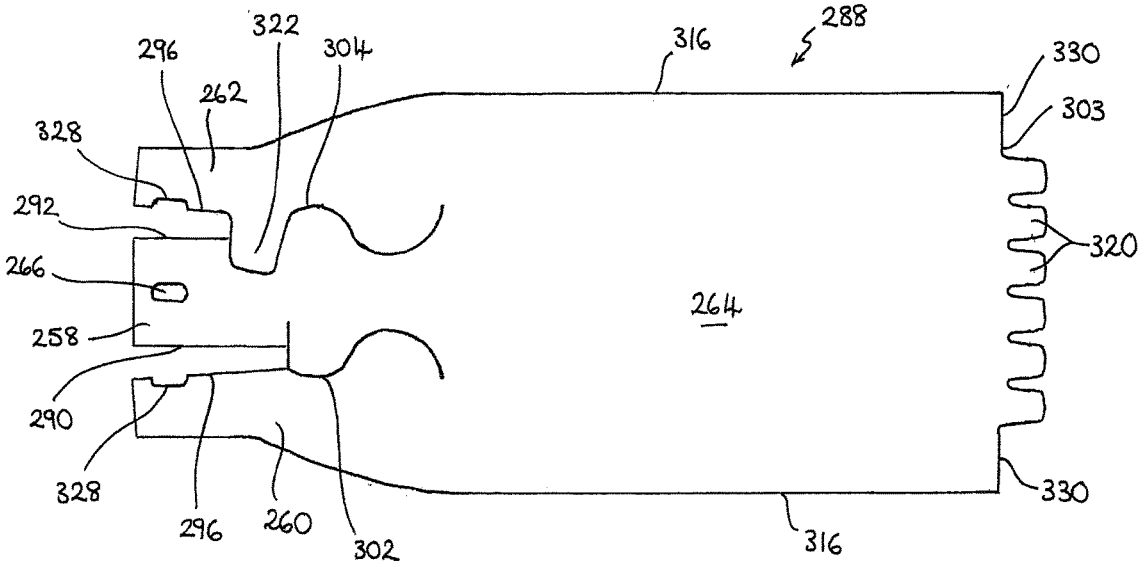
FIG. 17 shows an outline of a blank according to a preferred embodiment of the invention used to form a second side wall element of the shell of FIG. 14.

Blanks used to form the first and second side wall elements 218, 220 respectively are shown in FIGS. 16 and 17. A first side wall blank 286 is used to form the first side wall element 218, and a second side wall blank 288 is used to form the second side wall element 220. The first and second blanks 286, 288 are similar to the side wall blanks 86, 88 of the first embodiment and like features have been indicated by reference numerals incremented by 200.

Each of the blanks 286, 288 includes a substantially rectangular main body panel 264 and three neck panels 258, 260, 262 extending from a first end of the main body panel 264. A first single cut line 302 in each of the blanks 286, 288 defines a length of both a first side edge 290 of a central neck panel 258 and a first side edge 296 of a first outer neck panel 260. A second single cut line 304 in each of the blanks 286, 288 defines a length of both a second side edge 292 of the central neck panel 258 and a first side edge 296 of a second outer neck panel 262.

In the second side wall blank 288, the second single cut line 304 defines the neck tab 322 that extends from the first side edge 296 of a second outer neck panel 262.

An aperture 266 is formed in the central neck panel 258 of each of the blanks 286, 288. In this embodiment the aperture 266 is elongate and is centrally located across a width of the central neck panel 258 between the two side edges 290, 292.

A recess 328 is formed in the first side edge 296 of the first outer neck panel 260 and the first side edge 296 of the second outer neck panel 262 proximate a distal end of each of the outer neck panels 260, 262. Each of the recesses 328 is substantially the same shape as half the aperture 266. The recesses 328 are located such that when the side wall elements 218, 220 are formed, the recesses 328 align around the aperture 266.

A plurality of base tabs 320 extend from an end edge 303 of the main body panel 264 of each of the blanks 286, 288. In this embodiment, in the first side wall blank 266, the series of base tabs 320 extends fully across the width of the main body panel 264 which includes a tab panel 314 extending along each side edge 316 of the main body panel 264. In the second side wall blank 268, the series of base tabs 320 extends from a central portion of the main body panel 264 and two outer portions 330 of the end edge 303, without any base tabs 320, are present adjacent each side edge 316. When the bottle 201 is constructed, the tab panels 314 will overlie edge regions of the main body panel 264 of the second side wall element 220 and will, therefore, at least partially cover the outer portions 330 of the end edge 303.

The method of construction of the bottle 201 is substantially the same as the method of construction of the container 1 of the first embodiment and will not be described in detail here. A number of features of the method of construction are, however, highlighted below.

The side wall blanks 286, 288 are formed using suitable heated tools to create the first and second side wall elements 218, 220. Following forming of the main body panel into a semi-cylindrical shape, the central neck panel 258 is then formed, followed by the outer neck panels 260, 262, substantially as described above in relation to the first embodiment. In this way the outer neck panels 260, 262 lie radially outwardly of the central neck panel 258 in the final bottle 201. Importantly, the neck tab 322 lies radially outwardly of and extends over a part of the outer neck panel 260. Furthermore, the neck tab 322 is not adhered to either of the central neck panel 258 or the outer neck panel 260.

A further step in the construction method is to press or form a base blank, i.e. a cardboard disc, into the base element 222 having the central region 324 and the peripheral skirt portion 326. This pressing step may be carried out before, after or during the pressing of the first and second side wall blanks 286, 288. The base blank is pressed or formed using suitable heated tools.

Once all of the first, second and third elements 218, 220, 222 have been formed the complete bottle 201 can be assembled. The fitment and bag are positioned between and engaged with the side wall elements, and the side wall elements are bonded or adhered to each other, as described above in relation to the first embodiment.

The base element 222 is also positioned between the side wall elements 218, 220 so that the side wall elements 218, 220 extend around a circumference of the element 222 and the first surface 327 of the base element 222 faces in a direction away from a neck portion 204 of the shell 212. The base tabs 320 are then folded inwardly around the base element 222 and are bonded or adhered to the first surface 327 of the skirt portion 326 of the base element 222. The base tabs 320, therefore, form the support on which the bottle 201 may stand in use.

A final, optional, step in the method of construction of the bottle 201 is to wrap a strip or band of flexible material around the neck portion 204 of the bottle 201 to cover part of the fitment 216 and the apertures 266. The flexible material may be in the form of adhesive tape, metal foil or a shrink wrap material, for example.

Once the bottle 201 has been constructed the bag 214 can be filled with a liquid, for example wine. The bottle 201 is then sealed closed using a suitable sealing means, such as a screw cap (not shown), engaged with the fitment 216.

The foregoing description has primarily described two embodiments of the container and corresponding methods of construction. It will be appreciated, however, that in other embodiments, aspects of the shape and design of the container may be different, and steps in the method of construction may vary from what has been described.

In some embodiments adhesive may be applied to different regions of the first and second blanks 86, 88, 286, 288 and/or adhesive may be applied to regions of the third blank. In other embodiments the elements 18, 20, 22, 218, 220, 222 of the shell 12, 212 may be bonded together using other bonding means such as tape or mechanical fastening means.

It may be advantageous, in some embodiments, for each of the side wall elements of the shell 12 to include one main body tab portion and one neck tab portion. In this way the blanks for each of the first and second side wall elements may be identical. In these embodiments each of the tab portions would overlap externally a corresponding edge region of the other side wall element.

In other embodiments of the container the base element may be secured to the side wall elements in a different configuration. For example, a side wall of the base element may adhere to an external surface of the side wall.

In preferred embodiments, a cylindrical support tube is used to ensure that the side wall 24 of the shell 12 is of a constant and consistent diameter during construction of the container 1. In these embodiments the support tube is located around the bag 14 when the bag 14 is positioned between the first and second side wall elements 18, 20 of the shell 12. The first and second elements 18, 20 can then be bonded together around the support tube, such that an outer diameter of the support tube determines the inner diameter of the main body portion 2 of the shell 12. The inner diameter of the neck portion 4 of the shell 12 is determined by an outer diameter of the trunk portion 76 of the fitment 16. Once the first and second elements 18, 20 have been bonded together, the support tube can be removed and then the base element 22 can be bonded to the first and second elements 18, 20 as described above.

Although the above-described containers 1, 201 are substantially cylindrical, in other preferred embodiments the main body portion and the neck portion of the shell, and therefore the container, may have a hexagonal or octagonal cross-sectional shape. It will be appreciated that the main body portion and neck portion of containers of other embodiments may have any desired three-dimensional shape that may be formed from a flat sheet of cardboard and which form a continuous side wall of the container surrounding a bag.

In some embodiments it may also be desirable to include embossed or debossed decorative details in the shell 12, 212 of the container 1, 201. Suitable male and female tools may be used to form embossed shapes that protrude from the external surface 40 of the shell or debossed shapes that are recessed relative to the external surface 40. The regions of embossing or debossing may be formed in the main body portion 2 and/or the neck portion 4 of the shell 12, 212. In some embodiments the blanks may be embossed or debossed before being formed into the first and second side wall elements 18, 20, 218, 220. In other embodiments suitable tools may be used to emboss or deboss regions of the formed elements 18, 20, 218, 220. This technique may, for example, be used to form a decorative detail in the form of an embossed bunch of grapes in the main body portion 2 of the shell 12 when the container 1 is to be used as a wine bottle.

The present invention, therefore, provides an improved container having a paperboard shell and an inner bag that overcomes at least some of the disadvantages of previous container designs, a blank for use in forming such a container and a method of construction of such a container.

The invention claimed is:

1. A container comprising a paperboard outer shell and an inner lining connected to the shell, the container having a cylindrical main body portion having a first diameter and a cylindrical neck portion having a second, smaller diameter, an opening of the container being at an end of the neck portion, and the neck portion extending from a first end of the main body portion and a base on which the container may be supported in use being provided at a second end of the main body portion, and the outer shell comprising:

a first side wall element including a part of the neck portion and a part of the main body portion of the container;

a second side wall element including a part of the neck portion and a part of the main body portion of the container; and a third base element including the base of the container, wherein, said first, second and third elements are bonded together to form the shell, and wherein said first, second and third elements are formed from flat sheet material pressed to form the 3-dimensional shape of the shell, and wherein the neck portion of the first element comprises a first overlapping panel of sheet material that overlaps a second panel of the neck portion of the first element, and the neck portion of the second element comprises a first overlapping panel of sheet material that overlaps a second panel of the neck portion of the second element.

2. A container as claimed in claim 1, wherein the first and second elements form a continuous side wall of the shell.

3. A container as claimed in claim 1, wherein the neck portion of each of the first and second elements comprises at least two overlapping panels of sheet material.

4. A container as claimed in claim 1, wherein said overlapping panels of material are bonded together by an adhesive.

5. A container as claimed in claim 1, in which the inner lining comprises a fitment and a bag secured to the fitment, and wherein the fitment is engaged with the neck portions of the first and second elements of the shell and the bag extends into the main body portion of the container.

6. A container as claimed in claim 5, wherein the neck portion of each of the first and second elements includes an aperture.

7. A container as claimed in claim 6, wherein the fitment includes lugs and wherein the lugs protrude through the apertures in the neck portions of the first and second elements of the shell.

8. A container as claimed in claim 7, wherein the container comprises a flexible strip of material wrapped around the neck portion of the container to cover said lugs and apertures.

9. A container as claimed in claim 6, wherein the apertures are diametrically opposite each other in the neck portion of the container.

10. A blank used for manufacturing either of the first and second side wall elements of a container as claimed in claim 1, the blank being formed of a flat sheet of paperboard, and the blank comprising:

a substantially rectangular main body panel having two opposing side edges and two opposing end edges;

a central neck panel extending centrally from a first end edge of the main body panel, the central neck panel having first and second side edges and a distal end edge;

a first outer neck panel extending from the first end edge of the main body panel adjacent to and on a first side of the central neck panel, the first outer neck panel having opposing first and second side edges and a distal end edge, the first side edge being closer to the central neck panel that the second side edge; and a second outer neck panel extending from the first end edge of the main body panel adjacent to and on a second, opposite side of the central neck panel to the first outer neck panel, the second outer neck panel having opposing first and second side edges and a distal end edge, the first side edge being closer to the central neck panel that the second side edge.

11. A blank as claimed in claim 10, wherein a first tab panel extends from and along at least one of the side edges of the main body panel and a second tab panel extends from the second side edge of at least one of the outer neck panels.

12. A blank as claimed in claim 10, wherein a distal end portion of the first side edge of the first outer neck panel extends in a direction away from the first side edge of the central neck panel, such that a first notch is formed in the blank between distal end portions of the first outer neck panel and the central neck panel, and a distal end portion of the first side edge of the second outer neck panel extends in a direction away from the second side edge of the central neck panel, such that a second notch is formed in the blank between distal end portions of the second outer neck panel and the central neck panel.

13. A blank as claimed in claim 10, wherein an aperture is provided in the central neck panel.

14. A method of manufacturing a container as claimed in claim 1, the method comprising the steps of:

cutting a first side wall blank from a flat sheet of paperboard material;

hot pressing the first side wall blank to form the first side wall element;

cutting a second side wall blank from a flat sheet of paperboard material;

hot pressing the second side wall blank to form the second side wall element;

cutting a base blank from a flat sheet of paperboard material;

hot pressing the base blank to form the third element;

inserting the inner lining between the first and second side wall elements; and bonding the first, second and third elements together to form the shell around said lining.

15. A method as claimed in claim 14, wherein the method comprises:

before hot pressing the first side wall blank to form the first side wall element applying a heat activated adhesive to regions of the first side wall blank;

hot pressing the first side wall blank to form the first side wall element with the adhesive in a non-activated state; and subsequently, activating the adhesive using a heat source to bond the first, second and third elements together.

16. A method as claimed in claim 14, wherein the first side wall blank comprises a substantially rectangular main body panel having two opposing side edges and two opposing end edges, a central neck panel extending centrally from a first end edge of the main body panel, the central neck panel having first and second side edges and a distal end edge, a first outer neck panel extending from the first end edge of the main body panel adjacent to and on a first side of the central neck panel, the first outer neck panel having opposing first and second side edges and a distal end edge, the first side edge being closer to the central neck panel than the second side edge, and a second outer neck panel extending from the first end edge of the main body panel adjacent to and on a second, opposite side of the central neck panel to the first outer neck panel, the second outer neck panel having opposing first and second side edges and a distal end edge, the first side edge being closer to the central neck panel than the second side edge, and a first tab panel extends from and along at least one of the two opposing side edges of the main body panel and a second tab panel extends from the second side edge of at least one of the first or second outer neck panels, and wherein the method further comprises:

applying an adhesive to said first and second tab panels;

joining the first and second side wall elements such that the tab panels of the first side wall element overlap regions of the second side wall element; and adhering the tab portions of the first side wall element to the second side wall element.

17. A method as claimed in claim 14, wherein the first and second side wall blanks each comprise a substantially rectangular main body panel having two opposing side edges and two opposing end edges, a central neck panel extending centrally from a first end edge of the main body panel, the central neck panel having first and second side edges and a distal end edge, a first outer neck panel extending from the first end edge of the main body panel adjacent to and on a first side of the central neck panel, the first outer neck panel having opposing first and second side edges and a distal end edge, the first side edge being closer to the central neck panel that the second side edge, and a second outer neck panel extending from the first end edge of the main body panel adjacent to and on a second, opposite side of the central neck panel to the first outer neck panel, the second outer neck panel having opposing first and second side edges and a distal end edge, the first side edge being closer to the central neck panel that the second side edge, and wherein the method steps of hot pressing the first and second side wall blanks to form the first and second side wall elements comprises forming a neck region of each of the first and second elements by overlapping an edge region of each of said outer neck panels with the central neck panel.

18. A method as claimed in claim 17, wherein the method further comprises adhering the outer neck panels of each blank to the respective central neck panel of each blank.

19. A method as claimed in claim 14, wherein the first and second side wall blanks each include an aperture, the inner lining comprises a fitment having lugs and a bag secured to the fitment, and wherein the step of inserting the inner lining between the first and second side wall elements comprises engaging the lugs of the fitment through the apertures of the first and second side wall elements.

20. A method as claimed in claim 14, wherein the method steps of inserting the inner lining between the first and second side wall elements and bonding the first, second and third elements together to form the shell around said lining comprises the steps of:

positioning a support tube around a part of said inner lining;

locating said first and second side wall elements around the support tube;

bonding the first and second side wall elements together; and after bonding said elements together, withdrawing the support tube from between the inner lining and the first and second side wall elements.

21. A method as claimed in claim 14, wherein the method comprises wrapping a flexible strip of material around the neck portion of the container after the first, second and third elements have been bonded together.

22. A container comprising a paperboard outer shell and an inner lining connected to the shell, the container having an elongate cylindrical main body portion having a first diameter, an elongate cylindrical neck portion having a second, smaller diameter and a tapered shoulder portion formed by an overlapping panel extending between the neck portion and the main body portion, an opening of the container being at an end of the neck portion and a base on which the container may be supported in use being provided at an end of the main body portion, and the outer shell comprising:

a first side wall part including a part of the neck portion and a part of the main body portion of the container;

a second side wall part including a part of the neck portion and a part of the main body portion of the container; and a third base part including the base of the container, wherein, the first, second and third parts are formed from flat sheet material pressed to form the 3-dimensional shape of the shell and are bonded together to form the shell, and the inner lining comprises a fitment including a pair of lugs extending from opposite sides of the fitment, the lugs extending through apertures in the neck portion of the container.

23. A container as claimed in claim 22, wherein each of the first and second side wall parts includes a semi-dome shaped shoulder portion between a semi-cylindrical part of the neck portion and a semi-cylindrical part of the main body portion of the container.

24. A container as claimed in claim 22, wherein the apertures in the neck portion of the container are elongate and extend in a direction substantially parallel to an axis of the container.

25. A container comprising a paperboard outer shell and an inner bag connected to the shell, the container having a main body portion and a neck portion, an opening of the container being at an end of the neck portion, and the neck portion extending from a first end of the main body portion and a base on which the container may be supported in use being provided at a second end of the main body portion, and the outer shell comprising:

a first side wall element including a part of the neck portion and a part of the main body portion of the container;

a second side wall element including a part of the neck portion and a part of the main body portion of the container; and a third base element including the base of the container, wherein, said first, second and third elements are bonded together to form the shell, and wherein said first, second and third elements are formed from flat sheet material pressed to form the 3-dimensional shape of the shell, and the neck portion of each of the first and second elements comprises at least two overlapping panels of sheet material that overlap to taper the neck portion.

* * * * *